United States Patent [19]

Watchman

[11] Patent Number: 4,644,136

[45] Date of Patent: Feb. 17, 1987

[54] TOWEL WARMER

[76] Inventor: Kenneth C. Watchman, 2621 N. Jay St., Chandler, Ariz. 85224

[21] Appl. No.: 702,791

[22] Filed: Feb. 19, 1985

[51] Int. Cl.[4] ..... F27D 7/04

[52] U.S. Cl. ..... 219/400; 219/385; 219/367; 219/518

[58] Field of Search ..... 219/400, 385, 386, 364, 219/366, 367, 368, 369, 370, 413, 518; 126/21 R, 21 A; 34/218, 219, 222, 223, 224, 225

[56] References Cited

U.S. PATENT DOCUMENTS

| | | | |
|---|---|---|---|
| 1,943,575 | 1/1934 | Abendroth | 219/400 |
| 3,259,996 | 7/1966 | Hull | 219/400 |
| 3,610,881 | 10/1971 | Stewart | 219/400 |
| 3,839,622 | 10/1974 | Mastin | 219/413 |
| 3,977,387 | 8/1976 | Lawler | 126/21 A |
| 4,117,309 | 10/1978 | Cayley | 219/385 |
| 4,140,893 | 2/1979 | Renteria | 219/400 |
| 4,295,419 | 10/1981 | Langhammer | 219/400 |
| 4,491,065 | 1/1985 | Poulson | 126/21 A |

*Primary Examiner*—E. A. Goldberg
*Assistant Examiner*—Teresa J. Walberg
*Attorney, Agent, or Firm*—Nissle & Leeds

[57] ABSTRACT

A towel warming apparatus contacts all of the outer exposed surfaces of a folded towel with a continuous flow of warm air and can be readily installed in the wall of a bathroom to warm a towel with heat drawn from hot water flowing through a conduit to a faucet. The warm air flows between inner and outer walls and passes through perforations in all the inner walls to contact the towel on all exposed surfaces.

4 Claims, 7 Drawing Figures

TOWEL WARMER

FIELD OF THE INVENTION

This invention relates to apparatus for warming towels and other fabric items.

In another respect, this invention relates to towel warming apparatus which contacts all of the outer exposed surfaces of a towel or of a piece of textile material with a continuous flow of warm air.

In a further respect, the invention relates to towel warming apparatus which is readily installed in the wall of an existing bathroom to warm a towel with heat drawn from hot water flowing through a conduit to a faucet.

In still another respect, the invention relates to towel warming apparatus which automatically commences operation when a towel is placed on the apparatus and ceases operation when the towel is removed.

DESCRIPTION OF RELATED ART

Devices for warming towels and other textile articles are well known in the art. See, for example, U.S. Pat. Nos. 4,117,309 to Cayley, 3,849,629 to Graham, 3,626,152 to Governale, and 2,815,585 to Thompson. Such devices generally include an enclosed towel warming chamber and a heating element positioned in or adjacent to the chamber. Heat from the element radiates into the air in the chamber to warm and, if necessary, dry a towel or other fabric article placed in the chamber. One of the disadvantages of such prior art towel warmers is that heat is produced by utilizing a resistance-type electric heating element of the general type commonly found in water heaters. While such heating elements consume substantial amounts of electricity, they are effective in hot water heaters because they directly contact and transmit heat to water. However, in conventional towel warming units, heat first radiates from the heating element to air intermediate a towel and heating element and is then conducted from the heated air to the towel, or, heat radiates from the heating element and directly against the towel or a heat conductive towel support surface. Radiation is comparatively slow, ineffective method of transferring heat from a heat source over a distance through air to an object. Further, in prior art towel warming units heat is not evenly distributed over all exposed surfaces of a towel. The towel surfaces facing the heating element are warmed while the surfaces facing away from the element are warmed to a lesser degree.

OBJECTS OF THE INVENTION

Accordingly, it would be highly desirable to provide improved towel warming apparatus which would consume only minimal amounts of electricity, would efficiently transfer heat from a heat source to a towel or other textile article placed in the apparatus, and, would uniformly heat all exposed surfaces of the towel.

Therefore, it is a principal object of the invention to provide improved towel warming apparatus.

Another object of the invention is to provide improved towel warming apparatus in which heat is rapidly carried from a heating element to a towel and is evenly distributed over all exposed surfaces of the towel.

A further object of the instant invention is to provide improved towel warming apparatus which consumes minimal amounts of electricity.

Still another object of the invention is to provide improved towel warming apparatus which occupies only a minimal amount of usable living space in a bathroom or bedroom because the apparatus can effectively warm a folded towel and, consequently, only requires a towel warming chamber of relatively small size.

BRIEF DESCRIPTION OF THE DRAWINGS

These and other, further and more specific objects and advantages of the invention will be apparent to those skilled in the art from the following detailed description thereof, taken in conjunction with the drawings in which.

DESCRIPTION OF THE PREFERRED EMBODIMENTS

Briefly, in accordance with my invention, I provide improved towel warming apparatus. The apparatus comprises a housing including a plurality of interconnected generally continuous outer walls enclosing and defining an inner space, and a plurality of perforated inner walls connected to the housing and spaced away from the outer walls to bound air flow passages between the inner and outer walls and to bound an inner towel storage area; means for producing heat; a fan for causing air to flow over the heat producing means and through air flow passages and perforated walls into the towel storage chamber and over the exposed surfaces of a towel placed in the storage chamber; and a vent formed in one of the outer walls through which air from the towel storage chamber flows out of the towel warming apparatus.

Figure 1:
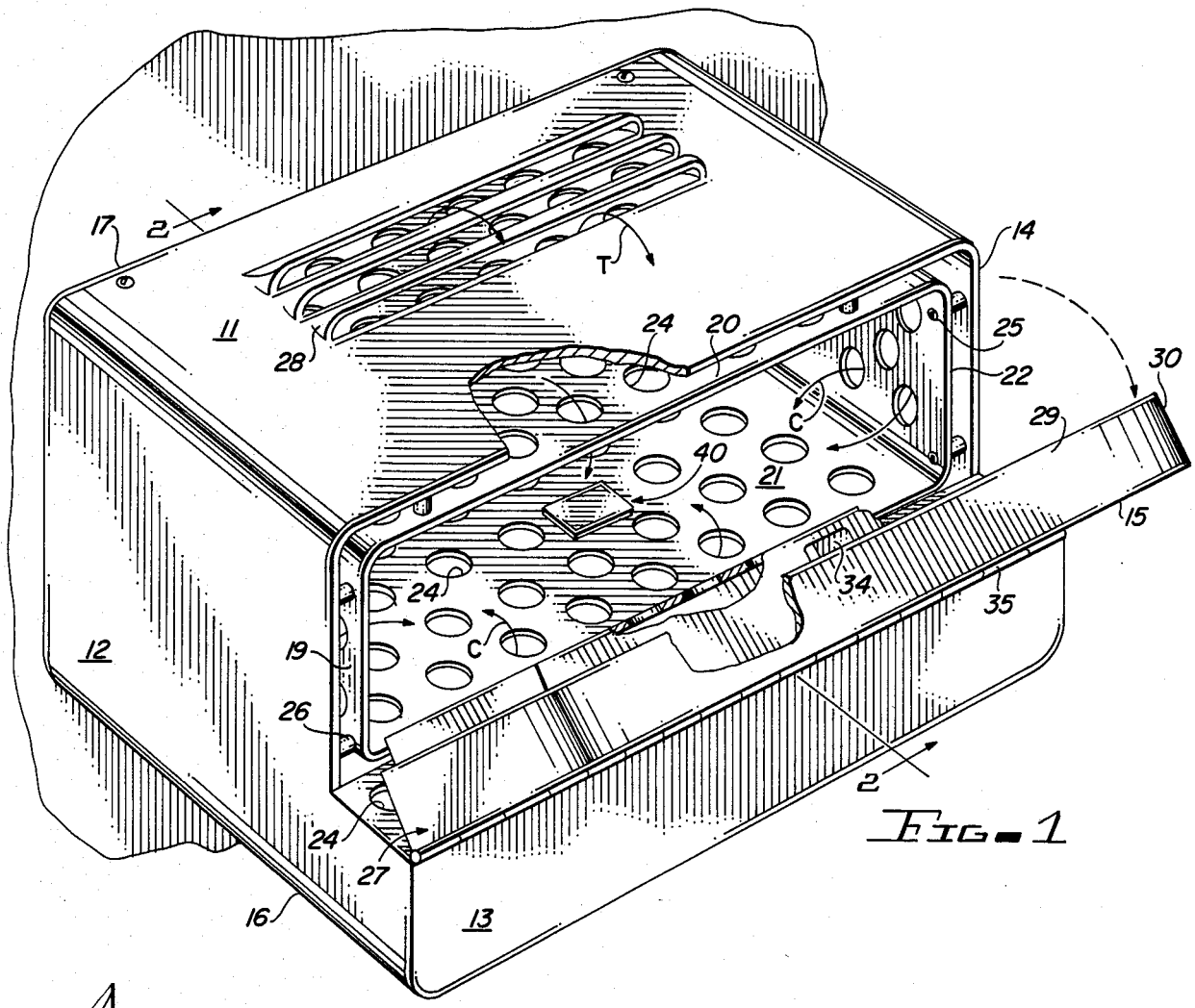
FIG. 1 is a perspective view illustrating towel warming apparatus constructed in accordance with the principles of the invention.
Figure 2:
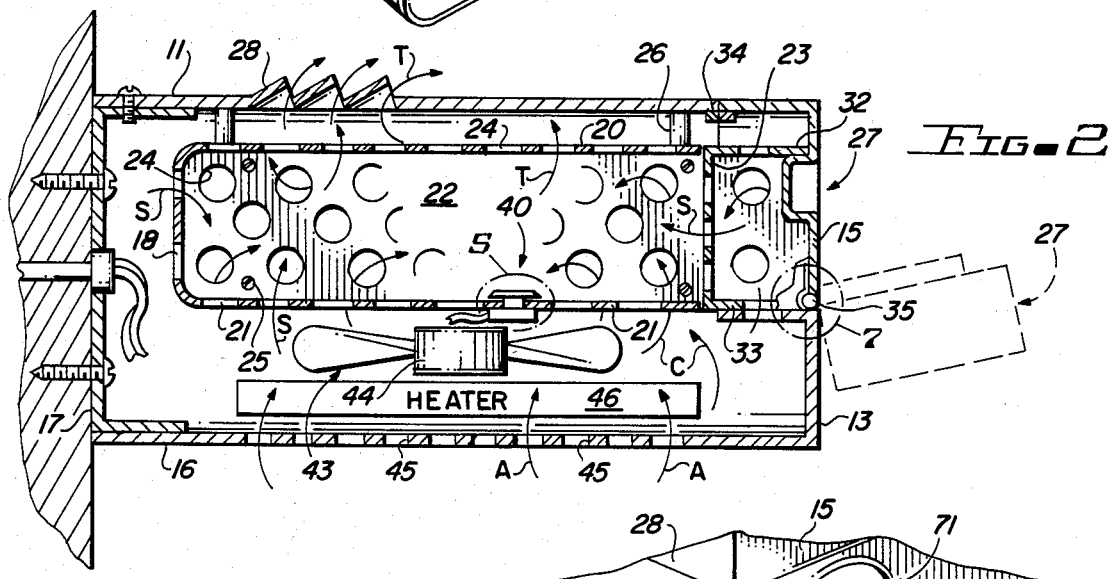
FIG. 2 is a section view of the towel warming apparatus of FIG. 1 taken along section line 2—2 thereof and further illustrating interior construction details thereof.
Figure 5:
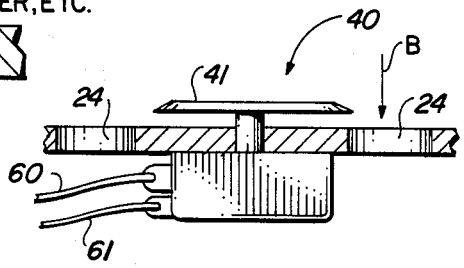
FIG. 5 is a side view illustrating the towel sensing switch utilized to initiate operation of the apparatus of the invention when a towel is placed therein.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 and 2 depect towel warming apparatus constructed in accordance with the principles of the invention and including a housing having a plurality of generally continuous, solid, interconnected outer walls 11–17, 28–30 and a plurality of inner walls 18–23 spaced away from outer walls 11–17, 28–30 and having a plurality of circular perforations 24 formed therethrough. Perforated walls 19, 20, 22 are attached to outer walls 12, 11, 14, respectively, of the housing with screws 25 spacers 26. Louvers 28 are formed in upper outer wall 11. Door 27 includes outer solid, continuous wall portions 28–30, 15 and perforated wall portions 23, 32 and 33. Door 27 is pivotally attached to wall 13 by spring-loaded piano hinge 35. Magnets 34 maintain door 27 in the closed position illustrated in FIG. 2. When a towel or piece of other textile material is placed inside the towel warming chamber formed by perforated walls 18–23, the towel contacts and depresses panel 41 of switch 40 (FIG. 5) in the direction of arrow B to close and activate switch 40. When the towel is removed from the apparatus of FIGS. 1 and 2, spring loaded panel 41 rises to the position shown in FIG. 5 to open switch 40. Fan 43 is positioned beneath perforated wall 21 and is turned by hub motor 44 to draw air in the direction of arrows A through perforations 45, over heater 46, and through perforations 24 into the towel warming chamber bounded by walls 18–23. As shown in FIG. 2, air drawn over heater 46 by fan 43 travels through air flow passages bounded by inner walls 18–23 and outer walls 11–17, 28–30 and then travels through perforations 24 into the towel warming chamber.

Figure 4:
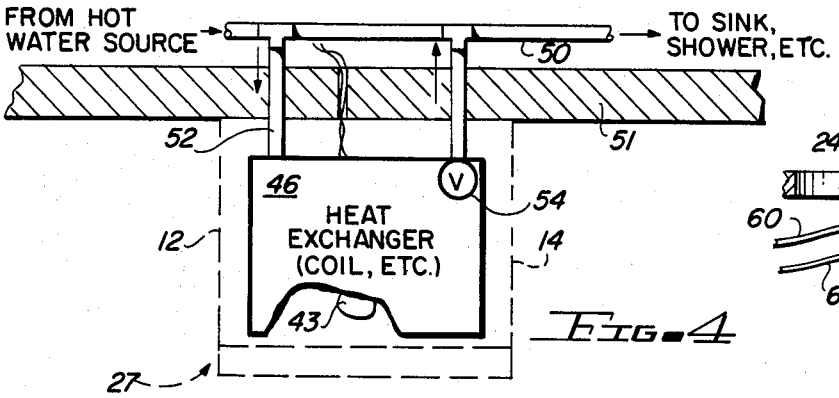
FIG. 4 is a schematic diagram illustrating installation of the towel warming apparatus of the invention on a wall to draw heat from hot water flowing through a conduit to a bath or sink.
Figure 6:
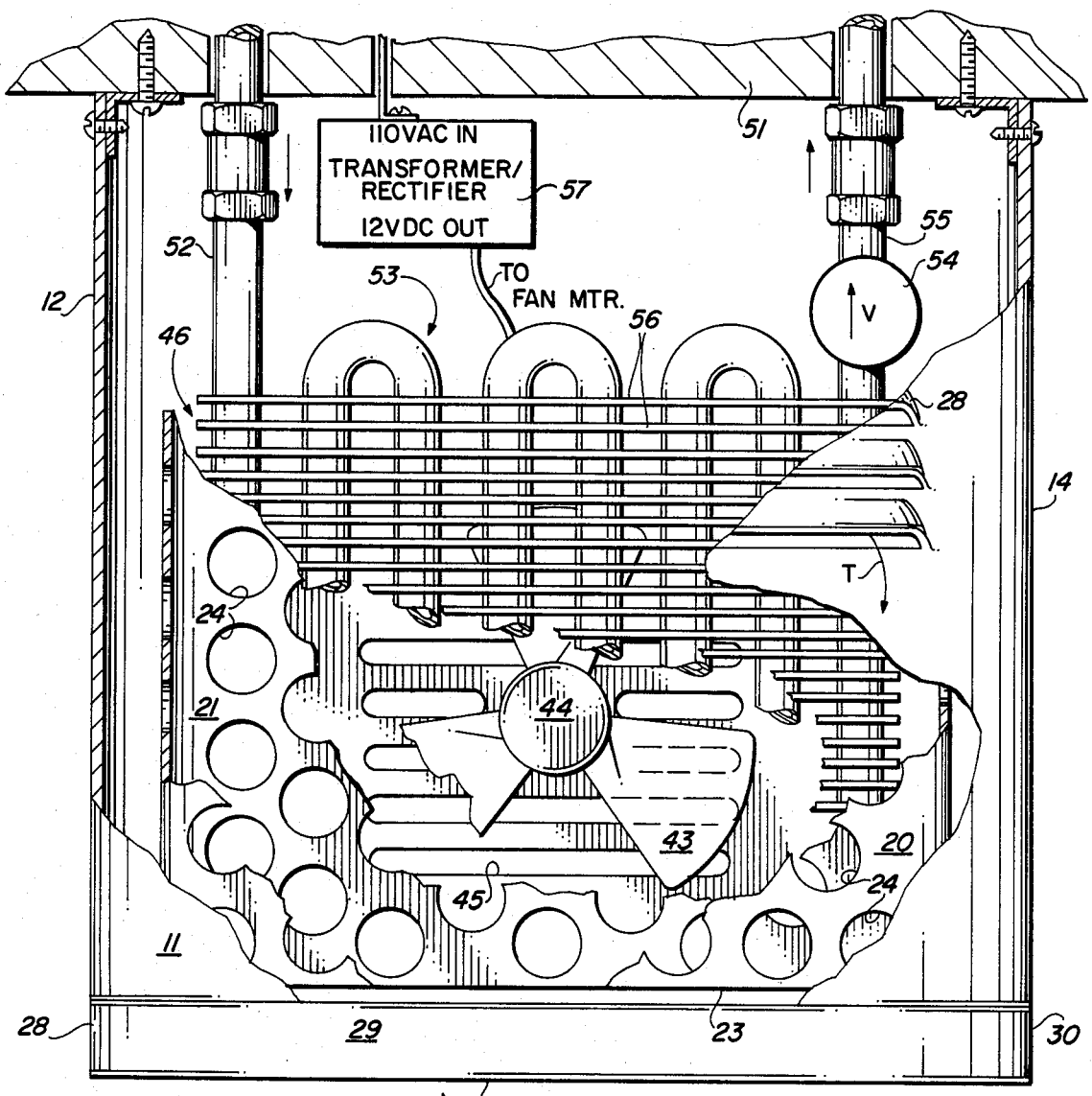
FIG. 6 is a top view of the towel warming apparatus of FIGS. 1 and 2 provided with a hot water heating coil, portions of the apparatus being broken away to illustrate internal construction details thereof; and, FIG. 7 is a side section view illustrating the pivotal attachment of the door of the towel warming apparatus of FIG. 6.

FIGS. 4 and 6 illustrate the towel warming apparatus of FIGS. 1 and 2 provided with a heater unit including a coil through which hot water is directed. The embodiment of the invention illustrated in FIGS. 4 and 6 is particularly useful in bathrooms in the home and in hotels since the apparatus can be mounted on wall 51 near existing conduit 50 carrying hot water to a bath or sink. When normally closed valve 54 is opened, hot water is diverted from conduit 50 through conduit 52 into coil 53. Water exiting coil 53 flows through conduit 55 back into conduit 50. Heat conductive fins 56 interconnect the sections of conduit comprising coil 53. The embodiment of the invention in FIGS. 4 and 6 consumes a minimal amount of electricity and makes it practical to power fan 43 with batteries carried in the apparatus, or, to utilize a transformer 57 to convert 110 VAC to a twelve volt DC output directed to fan 43.

In use of the towel warmer of FIGS. 1 and 2, door 27 is opened and a towel or other fabric article is placed in tht owel warming chamber, depressing member 41 of switch 40. Door 27 is then closed. When member 41 is depressed by the towel, switch 40 is closed, permitting electricity to flow through wires 60, 61 and activate fan 43 and, when heater 46 is electrically powered, to activate heater 46. Fan 43 draws air over heater 46 and directs the air through the open passages between the inner walls 18–23 and the outer walls 11–17, 28–30 and through perforations 24 into the towel warming chamber bounded by inner walls 18–23. Inner walls 18–23 and outer walls 11–17, 28–30 are shaped and dimensioned and properly positioned with respect to one another and with respect to fan 43 to cause air to flow upwardly through bottom wall 21 against the towel as indicated by arrows C, and to flow through side walls 18, 19, 22 and 23 as indicated by arrows S so that all surfaces of the towel positioned in the towel warming chamber are contacted by warm air flowing into the chamber. As indicated by arrows T, air flowing from the towel warming chamber exits through louvers 28 formed in outer wall 11.

The position of fan 43 and heater 46 in the towel warmer apparatus can be varied as can the relative position, shape and dimension of the inner 18–23 and outer 11–17, 28–30 walls. However, an important object of the invention is to direct a continuous flow of air generally over or against all outer exposed surfaces of a towel or other piece of fabric material placed in the towel warming chamber.

Figure 3:
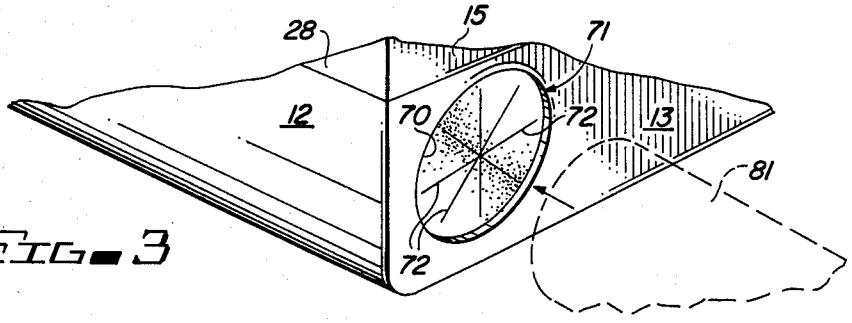
FIG. 3 is a partial perspective view illustrating the towel warming apparatus of the invention adapted to be utilized in conjunction with a conventional hair blower-dryer.

In FIG. 3, outer wall 13 of the towel warming apparatus of the invention has aperture 70 formed therethrough and thin resilient rubber disk 71 inserted therein to permit the nose 81 of a conventional hair blower-dryer to be inserted through the rubber disk into the towel warming apparatus beneath inner wall 21. Cuts 72 form a series of separable resilient pie-shaped flaps in the center of disk 71. When nose 81 is inserted through disk 71 and the hair blower-dryer is operated, warm air flows through nose 81 into the towel warming apparatus and through perforations 24 in the manner generally illustrated in FIGS. 1 and 2. Fan 43 and heater 46 can, of course, be disconnected or not operated when a conventional hair blower-dryer is utilized in the towel warming apparatus in the manner illustrated in FIG. 3.

In use of the towel warmer of FIGS. 4 and 6, door 27 is opened and a towel or other fabric article is placed in the towel warming chamber, depressing member 41 of switch 40 (not shown in FIGS. 4 and 6). Door 27 is then closed. When member 41 is depressed by the towel, switch 40 is closed, permitting electricity to flow through wires 60, 61 to activate fan 43 and to open valve 54 to permit hot water from conduit 50 to flow through conduit 52, coil 53 and conduit 55. Fan 43 draws air over heated coil 53 and fins 56 and directs the air through the passages between the inner walls 18–23 and the outer walls 11–17, 28–30 and through perforations 24 into the towel warming chamber bounded by inner walls 18–23. When the towel has been sufficiently warmed, door 27 is opened and the towel removed. After the towel is removed spring-loaded member 41 of switch 40 raises to the position shown in FIG. 5, causing switch 40 to open, fan 43 to turn off and valve 54 to close.

Figure 7:
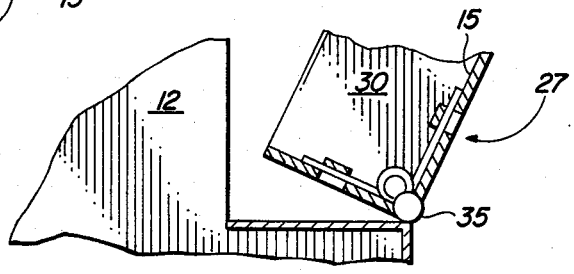

FIG. 7 illustrates the spring-loaded hinge 35 used in conjunction with door 27.

Having described my invention in such terms as to enable those skilled in the art to which it pertains to understand and practice it, and having described the presently preferred embodiments thereof, I claim:

1. Apparatus for warming a towel, said apparatus comprising (a) a housing including (i) a plurality of interconnected generally continuous retaining walls enclosing and defining an inner sapce, and (ii) a plurality of perforated inner walls connected to said housing and spaced away from said retaining walls to bound air flow passages between said inner and outer walls, and an inner towel storage area;

said perforated inner walls including a base wall for receiving and supporting a towel, an outer wall spaced away from, opposed to, and generally parallel to said base wall, a plurality of peripheral side walls extending between and circumscribing said base and outer walls, one of said retaining walls being opposed and generally parallel to said outer wall to bound with said outer wall said air flow passage between said outer wall and said one of said retaining walls, (b) a vent formed in said one of said retaining walls, said vent being opposed to said outer wall;

(c) means for producing heat;

(d) a fan for causing air to flow (i) over said heat producing means toward said inner towel storage area, (ii) through said base wall against the bottom surface of a towel in said inner storage area resting on said base wall, (iii) through
said performations in said base wall,
said inner storage area,
said perforations in said outer wall, and
said vent (iv) through said side walls into said inner storage area toward and against a towel placed therein, to contact all outer exposed surfaces of said towel with warm flowing air;

said base wall, outer wall and vent being positioned with respect to one another such that at least a portion of air flowing through said base wall into said inner storage area when a towel is not positioned in said storage area can blow in a generally fixed direction of travel through said storage area, through said outer wall and into said vent; another of said outer walls comprising a door which is opened to place a towel in said inner storage area; one of said side walls being opposed to and spaced apart from said door to form one of said air flow passages between said one of said side walls and said door.

2. The towel warming apparatus of claim 1, including switch means positioned on said base wall and adapted to activate said fan when a towel is placed on said base wall.

3. The towel warming apparatus of claim 2, wherein (a) said housing is attached to a wall in a structure constructed for human habitation; and, (b) said heat means comprises a coil heated by hot water drawn from a pipe in said wall.

4. The towel warming apparatus of claim 3, wherein said pipe normally transports hot water to a faucet in said structure.

* * * * *